US007914622B2

(12) United States Patent
Xue et al.

(10) Patent No.: US 7,914,622 B2
(45) Date of Patent: Mar. 29, 2011

(54) SMOKING ARTICLE HAVING FLAVORANT MATERIALS RETAINED IN HOLLOW HEAT CONDUCTIVE TUBES

(75) Inventors: Lixin Xue, Midlothian, VA (US); Liqun Yu, Midlothian, VA (US); Shuzhong Zhuang, Richmond, VA (US); Georgios D. Karles, Richmond, VA (US); Kent B. Koller, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 548 days.

(21) Appl. No.: 11/641,051

(22) Filed: Dec. 19, 2006

(65) Prior Publication Data

US 2007/0181140 A1 Aug. 9, 2007

Related U.S. Application Data

(60) Provisional application No. 60/751,995, filed on Dec. 21, 2005.

(51) Int. Cl.
*A24B 15/00* (2006.01)

(52) U.S. Cl. ..... 131/274; 131/335; 131/361

(58) Field of Classification Search ..... 131/334, 131/338–340, 274–279, 361, 335
See application file for complete search history.

(56) References Cited

U.S. PATENT DOCUMENTS 3,101,723 A * 8/1963 Seligman et al. ..... 131/342
3,258,015 A * 6/1966 Drummond et al. ..... 131/273
3,356,094 A 12/1967 Ellis et al.
3,756,249 A 9/1973 Selke et al.
4,340,072 A 7/1982 Bolt et al.
4,363,333 A * 12/1982 Matkin ..... 131/334
4,715,389 A 12/1987 Lynm et al.
4,732,168 A 3/1988 Resce et al.
4,756,318 A 7/1988 Clearman et al.
4,892,109 A * 1/1990 Strubel ..... 131/194
4,924,886 A * 5/1990 Litzinger ..... 131/194
4,961,438 A * 10/1990 Korte ..... 131/360
4,984,588 A * 1/1991 Stewart, Jr. ..... 131/364

(Continued)

FOREIGN PATENT DOCUMENTS

EP 0077123 A 4/1983

(Continued)

OTHER PUBLICATIONS

International Search Report and Written Opinion dated Nov. 5, 2007 for PCT/IB2006/004211.

*Primary Examiner* — Kat Wyrozebski
*Assistant Examiner* — Scott W Dodds
(74) *Attorney, Agent, or Firm* — Buchanan Ingersoll & Rooney PC

(57) ABSTRACT

A smoking article includes a cylinder of smoking material having at least one hollow tube having a heat conductive wall within the cylinder of smoking material and a filter system attached to the cylinder of smoking material. The filter system includes an adsorbent material therein. The at least one hollow tube extends from within the cylinder of smoking material through the adsorbent material. At least one flavorant material is retained within the at least one hollow tube, and upon exposure to heat from the heat conductive wall of the hollow tube the flavorant material releases a flavorant.

17 Claims, 2 Drawing Sheets

U.S. PATENT DOCUMENTS

| | | | | |
|---|---|---|---|---|
| 5,060,676 | A | 10/1991 | Hearn et al. | |
| 5,067,499 | A | 11/1991 | Banerjee et al. | |
| 5,435,326 | A * | 7/1995 | Gentry et al. | 131/344 |
| 5,458,107 | A | 10/1995 | Balogh et al. | |
| 5,690,127 | A | 11/1997 | Chapman et al. | |
| 2004/0159327 | A1 | 8/2004 | Dante | |
| 2004/0173230 | A1 | 9/2004 | Snaidr et al. | |

FOREIGN PATENT DOCUMENTS

| | | | |
|---|---|---|---|
| GB | 1410048 | * | 10/1975 |
| GB | 2225698 | A | 6/1990 |
| NL | 7214015 | A | 4/1973 |

* cited by examiner

SMOKING ARTICLE HAVING FLAVORANT MATERIALS RETAINED IN HOLLOW HEAT CONDUCTIVE TUBES

CROSS-REFERENCE TO RELATED APPLICATION

This application claims priority to U.S. Patent Provisional Application No. 60/751,995, filed Dec. 21, 2005, which is incorporated herein by this reference in its entirety.

BACKGROUND

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The tobacco rod is generally between 7.0 and 10.0 millimeters in diameter and 60 millimeters and 125 millimeters in length. Typically, the filter includes a plug of cellulose acetate tow attached to the tobacco rod by tipping paper. Ventilation of mainstream smoke can be achieved with a row or rows of perforations about a location along the filter.

SUMMARY

It would be desirable for smoking articles to have an effective flavor delivery system that has a capacity to bypass an adsorbent material within the filter system, whereby losses of flavorant are avoided and effectiveness of the adsorbent is maintained.

In accordance with one embodiment, a smoking article comprises: a cylinder of smoking material; a filter system attached to the cylinder of smoking material, the filter system having an adsorbent material; at least one hollow tube having a heat conductive wall within the cylinder of smoking material, the at least one hollow tube extending from within the cylinder of smoking material through the adsorbent material; and at least one flavorant material retained within the at least one hollow tube, and wherein the flavorant material releases a flavorant upon exposure to heat from the heat conductive wall of the hollow tube.

In accordance with a further embodiment, a smoking article comprises: a cylinder of smoking material containing at least one hollow tube within the cylinder of the smoking material, the at least one hollow tube having a heat conductive wall; and a filter system attached to the cylinder of smoking material, the filter system having an adsorbent material located between upstream and downstream filtering material and wherein the at least one hollow tube extends from within the cylinder of smoking material through the upstream filtering material and adsorbent material into the downstream filtering material.

DETAILED DESCRIPTION

Figure 1:
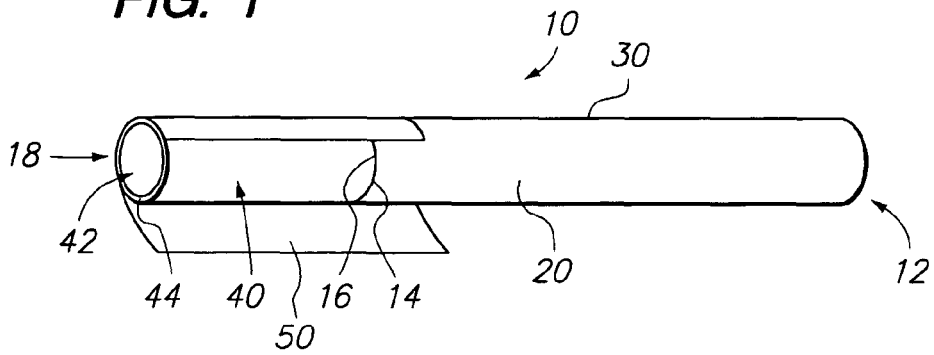
FIG. 1 shows a perspective view of a smoking article according to one embodiment having flavorant materials retained in a hollow tube of a heat conductive material, wherein the tipping material has been partially unfolded to reveal the filter system.

FIG. 1 shows a smoking article 10 in the form of a cigarette having at least one hollow tube 60 (not shown), wherein the tipping material 50 has been partially unfolded to reveal the filter system 40. Smoking articles 10 in the form of cigarettes typically include a generally cylindrical rod 20 of smoking material 21 (FIG. 2), contained in a circumscribing outer wrapper 30. The outer wrapper 30 is typically a porous wrapping material or paper wrapper. The rod 20 is typically referred to as a "tobacco rod" and has a lit end 12 and a mouth end 14. The tobacco rod 20 is used by lighting one end thereof, and aerosol (e.g., smoke) is provided as a result of the combustion of the burning smoking material 21, which is lit at a lit end 12. As such, the tobacco rod 20 burns back from the lit end 12 thereof towards the opposite end (i.e., mouth end 14) thereof, and the smoking material 21 of the tobacco rod 20 is consumed by combustion during smoking. The smoking material 21 is preferably a shredded tobacco or tobacco cut filler. However, any suitable smoking material 21 can be used.

The smoking article 10 also includes a filter system (or filter) 40 adjacent to the mouth end 14 of the tobacco rod 20 such that the filter system 40 and tobacco rod 20 are axially aligned in an end-to-end relationship, preferably abutting one another. The filter system 40 has a generally cylindrical shape, and the diameter thereof is essentially equal to the diameter of the tobacco rod 20. The ends (i.e., upstream end 16 and downstream end 18) of the filter system 40 are open to permit the passage of air and smoke therethrough.

The filter system 40 includes at least one filtering material 42 circumscribed by a plug wrap 44. The plug wrap 44 is a paper which optionally incorporates a carbonaceous material. The plug wrap 44 circumscribes the total length of the filter system 40. The filter system 40 is attached to the tobacco rod 20 by a tipping material 50, which preferably circumscribes both the entire length of the filter system 40 and an adjacent region of the tobacco rod 20. The tipping material 50 is typically a paper like product; however, any suitable material can be used. The inner surface of the tipping material 50 is fixedly secured to the outer surface of the plug wrap 44 and the outer surface of the wrapping material 30 of the tobacco rod 20, using a suitable adhesive. A ventilated or air diluted smoking article 10 can be provided with an air dilution means, such as a series of ventilation holes or perforations (not shown), each of which extend through the tipping material 50 and optionally the plug wrap 44.

Figure 2:
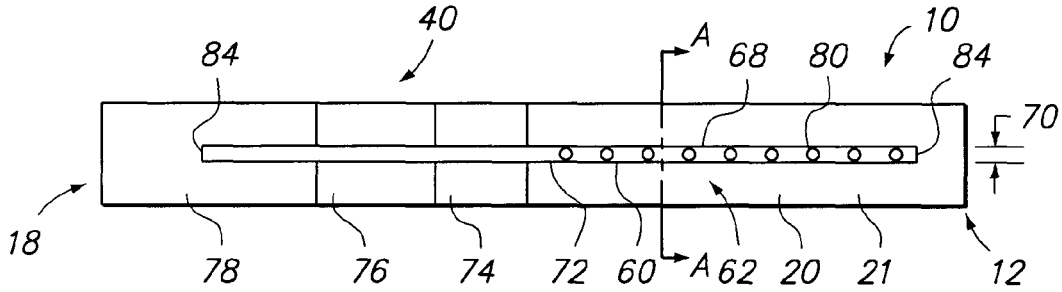
FIG. 2 shows a cross sectional view of FIG. 1 having a hollow tube of a heat conductive material with flavorant materials retained in the hollow tube.

FIG. 2 shows a smoking article 10 in the form of a cigarette having at least one hollow tube 60 of a heat conductive material 68 within the cylindrical rod 20 of smoking material 21 and filter system 40. As shown in FIG. 2, the filter system 40 preferably includes a first filtering material 74, an adsorbent material 76, and a second filtering material 78. However, it can be appreciated that any suitable filter system 40 having at least one segment or plug of an adsorbent material 76 can be used. In use, the at least one hollow tube 60 provides a passageway leading from the hollow tube 60 of the cylindrical rod 20 of smoking material 21 through the adsorbent material 76 to within the second filtering material 78 of the filter system 40.

Figure 3:
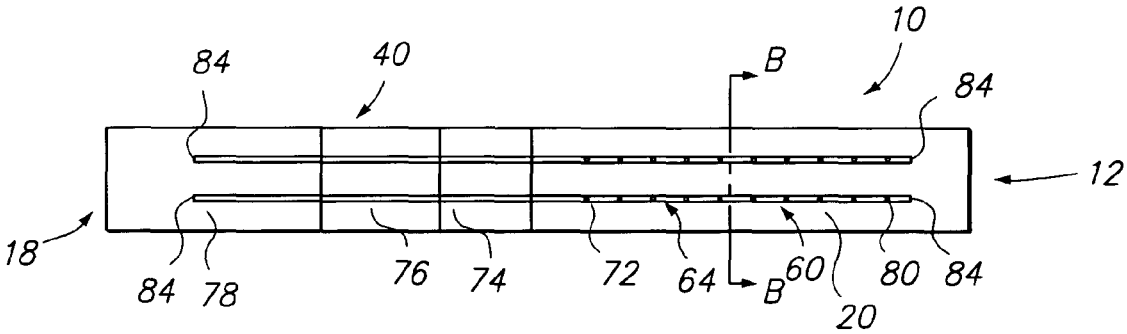
FIG. 3 shows a cross sectional view of another embodiment of a smoking article having a plurality of hollow tubes of a heat conductive material with flavorant materials retained in the hollow tubes.
Figure 4:
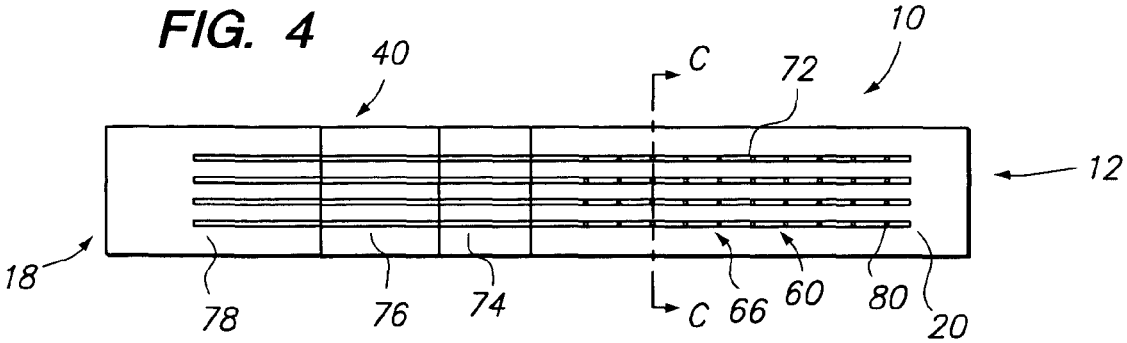
FIG. 4 shows a cross sectional view of a further embodiment of a smoking article having a plurality of hollow fibers of a heat conductive material with flavorant materials retained in the hollow fibers.

The tobacco rod 20 as shown in FIG. 2 is comprised of a smoking material 21 having at least one hollow tube 60 extending from within the tobacco rod 20 into the filter system 40. The at least one hollow tube 60 can be a centrally positioned hollow tube 62 as shown in FIG. 2, a plurality of hollow tubes 64 as shown in FIG. 3, or a plurality of hollow fibers 66 as shown in FIG. 4. The at least one hollow tube 60 has a heat conductive wall 72 made of a heat conductive material 68. During the smoking of the article 10, the heat generated by the lit end 12 of the article is transferred to the heat conductive wall 72 of the hollow tube 60, 62, 64 or fibers 66, which causes a flavorant material 80 retained within the at least one hollow tube 60, 62, 64 or fibers 66 to contribute to organoleptic attributes of mainstream smoke produced by the smoking article 10.

As shown in FIG. 2, the at least one hollow tube 60 preferably extends from within the tobacco rod 20 through the first filtering material 74 and adsorbent material 76 into the second filtering material 78 of the filter system 40. It can be appreciated, however, that the hollow tube 60 can be alternatively aligned with and abutting the second filtering material 78 rather than extending into the second filtering material 78 as shown in FIG. 2. Alternatively, the at least one hollow tube 60 can extend to any other suitable position within the smoking article 10. In addition, it can be appreciated that the hollow tube 60 can extend from within the tobacco rod 20 as shown in FIG. 2 or alternatively the hollow tube 60 can extend all the way to the lit end 12 of the smoking article 10. If the hollow tube 60 extends to the lit end 12 of the smoking article 10, a filler of loose tobacco or other suitable smoking material 21 can be placed within the hollow tube 60 to maintain the visual integrity (appearance) of the smoking article 10.

The at least one hollow tube 60 also includes a flavorant material 80, which is retained within the hollow tubes 60, 62, 64 or fibers 66. The flavorant material 80 provides an added flavor or flavorant to the smoking article 10 during the smoking action. Accordingly, it is preferable that the hollow tube or fibers 60, 62, 64, 66 have an internal volume, which is adequate to retain sufficient flavorant materials 80 to provide desired taste attributes to mainstream smoke produced by the smoking article 10. The at least one hollow tube 60 preferably has an internal diameter 70 in the range of about 0.1 mm to 5.0 mm (millimeters) and more preferably about 0.2 mm to about 2.0 mm. Alternatively, if the at least one hollow tube 60 is a bundle of hollow fibers 66, the hollow fibers 66 can have an internal diameter 70 in the range of about 2 to about 100 μm (micrometers) and more preferably about 5 to about 50 μm. The tobacco rod 20 is preferably between 7.0 and 10.0 mm (millimeters) in diameter and 60 to 125 mm in length. However, it can be appreciated that the tobacco rod 20 can be any suitable diameter and length.

The heat conductive material 68, which forms the heat conductive walls 72 of the hollow tubes and fibers 60, 62, 64, 66 also prevents the migration and penetration of the flavorant materials 80 into the smoking material 21 of the tobacco rod 20. The walls 72 preferably have a thickness of about 0.1 μm (micrometers) to about 3.0 μm and more preferably about 0.2 μm to about 1.0 μm. It can be appreciated that the heat conductive material 68 is also chosen based on the heat conductive materials 68 ability to provide rapid heat conducting properties to transfer heat from the lit end 12 of the smoking article 10 to the walls 72 of the hollow tubes and fibers 60, 62, 64, 66. Suitable heat conductive materials 68 for the hollow tubes and/or fibers 60, 62, 64, 66 can be graphite, any suitable metallic material or other suitable heat conducting material, which can be used in a smoking article 10.

As shown in FIG. 2, the flavorant materials 80 are retained inside the hollow space of the hollow tubes 60, 62, 64 or fibers 66. The flavorant materials 80 preferably extend the entire length of the hollow tube or fibers 60, 62, 64, 66. However, it can be appreciated that in an alternative embodiment, the flavorant materials 80 can be located only within the tobacco rod 20 portion of the hollow tubes or fibers 60, 62, 64, 66. In addition, the amount of flavorant materials 80 can vary depending on the desired aromas and specific flavorant materials 80.

During smoking, the heat generated in the lit end 12 of the smoking article 10 is transferred to the heat conductive wall 72 of the hollow tubes 60, 62, 64 or fibers 66. The heat from the heat conductive wall 72 causes the flavorant materials 80 retained inside the at least one hollow tube or fibers 60, 62, 64, 66 to generate a flavored aerosol or flavorant. The generated flavored aerosol or flavorant exits through the end 18 of the filter system 40 via the at least one hollow tube 60, 62, 64 or fibers 66 and the second filtering material 78. As shown, the hollow tubes or fibers 60, 62, 64, 66 deliver the flavorant to the buccal (mouth-end) of the filter 18 by bypassing the adsorbent material 76 of the filter system 40. Accordingly, the released flavored aerosol or flavorant is not subject to filtration adsorbtion from the adsorbent material 76.

The flavorant materials 80 can include any suitable material that generates flavor upon heating. The heating of the flavorant materials 80 preferably releases the flavorant as a result of expansion, evaporation, distillation, decomposition or other suitable reaction to the heat from the walls 72 of the hollow tubes or fibers 60, 62, 64, 66. The flavorant material 80 can be a single component or a multi-flavored component that is suitable for use in cigarette manufacturing such as menthol and vanillin. The flavorant materials 80 can also be an aroma of choice, such as peppermint, coconut, roasted, and/or toasted aromas. However, almost any flavor oil or composition can be used, such as having hydrophobic qualities. In addition, the concentration of flavorant materials 80, within the hollow tube or fibers 60, 62, 64, 66 can be adjusted or modified to provide the desired amount of flavorant material 80. Thus, the concentration of the flavorant materials 80, within the hollow tubes or fibers 60, 62, 64, 66 can vary depending on the desired aroma. The flavorant materials 80 can alternatively be encapsulated within an outer shell wall 82 (FIGS. 5 and 6) in the form of a capsule 84 having a suitable shell material such as cyclo-dextrine. It can be appreciated that any suitable shell material can be used for the encapsulation of the flavorant materials 80.

In addition, it can be appreciated that each of the open ends of the tubes 60, 62, 64 or fibers 66 can be temporarily sealed with heat meltable materials 84 such as waxes, or water sensitive materials such as polyvinyl alcohol, starch, flour, cyclo-dextrine and sugar. The sealing of the hollow tubes 60, 62, 64, or fibers 66 retain the flavorant material 80 within the tube 60, 62, 64 or fibers 66 and prevents the migration of the flavorant materials 80 through the open ends 86 of the hollow tubes 60, 62, 64 or fibers 66 to the tobacco rod 20 or filter system 40.

Upon lighting of the smoking article 10, the mainstream smoke is generated by and drawn from the tobacco rod 20 and through the filter system 40. Herein, the "upstream" and "downstream" relative positions between filter materials 42 and other features are described in relation to the direction of mainstream smoke as it is drawn from the at least one hollow tube 60 of the tobacco rod 20 and through the multi-component filter system 40. Preferably, the filter system 40 comprises a first, upstream filtering material 74, an adsorbent material 76 and a second filtering material 78.

The adsorbent material 76 is preferably downstream of the first filtering material 74 as shown in FIGS. 2 and 3. However, it can be appreciated that the adsorbent material 76 can be upstream of the first filtering material 74, wherein the filter system has only one filtering material 74 rather than a first and second filtering material. The adsorbent material 76 is preferably a porous material such as an activated carbon, a zeolite, a silica gel or a polymer based adsorbent or other suitable adsorbent material. As shown in FIG. 2, the adsorbent material 76 is preferably surrounded on each side by a plug of filtering material 74, 78. The filtering material 74, 78 is preferably cellulose acetate tow having a low resistance to draw ("RTD"). However, any suitable filtering material 74, 78 can be used.

For example, if the adsorbent material 76 is an activated carbon filter material, the activated carbon filter material can be in the form of granules and the like. In one embodiment, the activated carbon filter material is a high surface area, activated carbon such as a coconut shell based carbon of typical ASTM mesh size used in the cigarette filter manufacture. For example, the adsorbent material 76 can be a bed of activated carbon, which is adapted to adsorb constituents of mainstream smoke, particularly, those of the gas phase including aldehydes, ketones and other volatile organic compounds, and in particular 1, 3 butadiene, acrolein, isoprene, propionaldehyde, acrylonitrile, benzene, toluene, styrene, acetaldehyde or hydrogen cyanide. With respect to the adsorbent materials 76 in the form of carbon particles 20, it is preferred that the carbon particles have a mesh size of from 10 to 70, and more preferably a mesh size of 20 to 50.

When the cigarette or smoking article 10 is lit and a puff is drawn on the smoking article 10, air flow in the cigarette or smoking article 10 takes place in two regions, one through an annular bed of smoking material 21 contained between the at least one hollow tube 60 and the outer cigarette wrapper 30, and the other through the hollow tube 60. As the smoking article 10 is smoked the heat from the burning tobacco material at the lit end of the smoking article heats the flavorant materials 80 within the hollow tube 60 releasing the flavorant to the smoker. Since the flavorants are contained within the hollow tube or fibers 60, 62, 64, 66 the flavorants are delivered without loss of flavor via filtration through the adsorbent material 76.

FIG. 3 shows a smoking article 10 in the form of a cigarette having a plurality of hollow tubes 64 of heat conductive material 68 within the cylindrical rod 20 of smoking material 21 and the filter system 40. As shown in FIG. 3, the plurality of hollow tubes 64 extends from within the tobacco rod 20 of smoking article to filter system 40. The plurality of hollow tubes 64 extend entirely through the first filtering material 74 and adsorbent material 76 and partially into the second filtering material 78. The plurality of hollow tubes 64 are preferably centrally positioned within the tobacco rod 20 and filter system 40. However, it can be appreciated that any suitable configuration of the hollow tubes 64 within the tobacco rod 20 and filter system 40 can be used.

FIG. 4 shows a smoking article 10 in the form of a cigarette having a plurality of hollow fibers 66 of heat conductive material 68 within the cylindrical rod 20 of smoking material 21 and the filter system 40. As shown in FIG. 4, the plurality of hollow fibers 66 extends from within the tobacco rod 20 of smoking article to filter system 40. The hollow fibers 66 extend entirely through the first filtering material 74 and adsorbent material 76 and partially into the second filtering material 78. The hollow fibers 66 are preferably centrally positioned within the tobacco rod 20 and filter system 40. However, it can be appreciated that any suitable configuration of the hollow fibers 66 within the tobacco rod 20 and filter system 40 can be used.

Figure 5:
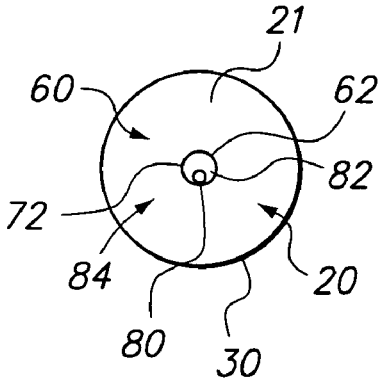
FIG. 5 shows a cross sectional view of FIG. 2 along the line A-A.

FIG. 5 shows a cross sectional view of FIG. 2 along the line A-A. As shown in FIG. 5, the smoking article 10 comprises at least one hollow tube 60 adapted to receive a flavorant material 80. The at least one hollow tube 60 has a wall 72 comprising a heat conductive material 68, such that during smoking of the article 10, the heat generated in the lit end of the article 10 is transferred to the heat conductive wall 72 of the hollow tube, which causes the flavorant materials 80 to generate flavor by expansion, evaporation, distillation, decomposition or other suitable methods.

Figure 6:
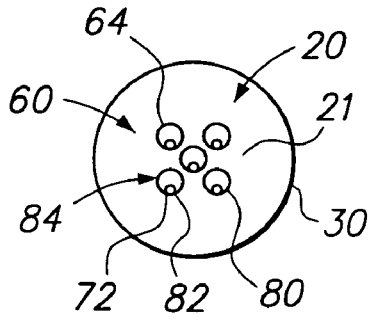
FIG. 6 shows a cross sectional view of FIG. 3 along the line B-B.

FIG. 6 shows a cross sectional view of FIG. 3 along the line B-B. As shown in FIG. 6, instead of a hollow tube 62 as shown in FIG. 5, the at least one hollow tube 60 can include a plurality of hollow tubes 64 having flavorant materials 80 located therein.

Figure 7:
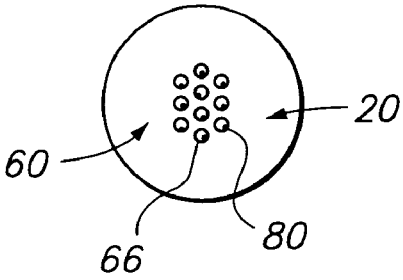
FIG. 7 shows a cross sectional view of FIG. 4 along the line C-C.

FIG. 7 shows a cross sectional view of FIG. 4 along the line C-C. As shown in FIG. 7, the hollow tube 60 is a plurality of hollow fibers 66. The hollow fibers 66 preferably have an internal diameter 70 of about 5 to 50 μm (micrometers).

The hollow tube 60 and filter system 40 having an adsorbent material 76 as shown in FIGS. 2-7 results in a smoking article 10 that lowers or reduces targeted smoke components, such as carbon monoxide (CO) and polycyclic aromatic hydrocarbons (PAH). The reduction in the targeted smoke components occurs as a result of the lower combustion temperature of the smoking material 21 from heat dispatching (transferring) from the hollow heat conductive tubes 60, 62, 64 and fibers 66. In addition, by combining the hollow tubes 60, 62, 64 and fibers 66 having a heat conductive material 68, a smoking article 10 or cigarette having reduced smoke constituents, can be produced which at the same time possess the original flavor of a full flavor cigarette. Specifically, by introducing the heat conducting hollow tube 60, 62, 64 and/or fibers 66 it can be appreciated that the smoking article 10 can lower the combustion temperature of the coal, so less carbon monoxide, polycyclic aromatic hydrocarbon and other targeted smoke constituents are generated during smoking of the smoking article 10.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:

a cylindrical rod of smoking material;

a filter system attached to the cylindrical rod of smoking material, the filter system having an adsorbent material;

a plurality of hollow tubes having a heat conductive walls within the cylindrical rod of smoking material, each of the plurality of hollow tubes extending from within the cylindrical rod of smoking material through the adsorbent material and having an internal diameter of between about 5 and 50 micrometers; and at least one flavorant material retained within the plurality of hollow tubes, and wherein the flavorant material releases a flavorant upon exposure to heat from the heat conductive wall of the hollow tube, and wherein mainstream smoke from the cylindrical rod of smoking material passes through the adsorbent material and the flavorant bypasses the adsorbent material within the filter system.

2. The smoking article of claim 1, wherein the adsorbent material is an activated carbon material.

3. The smoking article of claim 1, further comprising a first filtering material and a second filtering material, wherein the first and second filtering material arranged upstream and downstream of the adsorbent material.

4. The smoking article of claim 1, wherein the heat conductive wall prevents migration of the at least one flavorant material from the plurality of hollow tubes to the cylindrical rod of smoking material.

5. The smoking article of claim 3, wherein the first and second filtering materials are of a cellulose acetate material.

6. The smoking article of claim 1, wherein the adsorbent material is an activated carbon filter, which is surrounded by a plug of cellulose acetate tow on each side on the activated carbon filter.

7. The smoking article of claim 1, wherein the plurality of hollow tubes extend through a first filtering material and the adsorbent material, and partially into a second filtering material of the filter system.

8. The smoking article of claim 1, wherein the cylindrical rod of smoking material is a tobacco rod.

9. The smoking article of claim 1, wherein the plurality of hollow tubes are formed from graphite and/or a metallic material.

10. The smoking article of claim 1, wherein the plurality of hollow tubes extend through a first filtering material and the adsorbent material, and abuts a second filtering material of the filter system.

11. The smoking article of claim 1, wherein the plurality of hollow tubes transfer heat from a lit end of the smoking article to the at least one flavorant material within the plurality of hollow tubes.

12. The smoking article of claim 1, further comprising a sealing material on a lit end and/or a mouth end of the plurality of hollow tubes, which prevents migration of the at least one flavorant material though an open end of the plurality of hollow tubes.

13. The smoking article of claim 12, wherein the sealing material is a heat meltable material such as a wax and/or a water sensitive material such as polyvinyl alcohol, starch, flour, cyclo-dextrine and/or sugar.

14. A smoking article comprising:

a cylindrical rod of smoking material;

a plurality of hollow tubes within the cylindrical rod of smoking material, each of the plurality of hollow tubes having a heat conductive wall and an internal diameter of between about 5 and 50 micrometers;

a flavorant material located within the plurality of hollow tubes and wherein upon exposure to heat from the heat conductive wall of the plurality of hollow tubes, the flavorant material releases a flavorant; and a filter system attached to the cylindrical rod of smoking material, the filter system having an adsorbent material located between upstream and downstream filtering material and wherein the plurality of hollow tubes extend from within the cylindrical rod of smoking material through the upstream filtering material and adsorbent material into the downstream filtering material, and wherein mainstream smoke from the cylindrical rod of smoking material passes through the adsorbent material and the flavorant bypasses the adsorbent material within the filter system.

15. The smoking article of claim 14, wherein the cylindrical rod of smoking material is a tobacco rod.

16. The smoking article of claim 14, wherein the plurality of hollow tubes are formed from graphite and/or a metallic material.

17. The smoking article of claim 14, further comprising a sealing material on a lit end and/or a mouth end of the plurality of hollow tubes, which prevents migration of the at least one flavorant material though an open end of the plurality of hollow tubes.

* * * * *